US006698596B1

(12) United States Patent
Dean

(10) Patent No.: US 6,698,596 B1
(45) Date of Patent: Mar. 2, 2004

(54) MOBILE PUPPET STORAGE STAND

(76) Inventor: Herman R. Dean, 3316 Oak Hill Dr., Fayetteville, NC (US) 28301

( * ) Notice: Subject to any disclaimer, the term of this patent is extended or adjusted under 35 U.S.C. 154(b) by 0 days.

(21) Appl. No.: 10/210,311

(22) Filed: Aug. 1, 2002

Related U.S. Application Data

(60) Provisional application No. 60/309,263, filed on Aug. 2, 2001.

(51) Int. Cl.[7] ..... A47F 7/00

(52) U.S. Cl. ..... 211/13.1; 211/59.1; 211/163

(58) Field of Search ..... 211/13.1, 59.1, 211/163

(56) References Cited

U.S. PATENT DOCUMENTS 410,175 A * 9/1889 McAlister
1,327,581 A * 1/1920 Yeats
2,626,062 A * 1/1953 Manzella
3,297,372 A * 1/1967 Brader
3,979,786 A * 9/1976 Vierra et al.
4,036,367 A * 7/1977 Stambaugh et al. .... 211/163 X
5,065,871 A * 11/1991 Chan ..... 211/163 X
5,996,819 A * 12/1999 Klein ..... 211/59.1 X
6,182,841 B1 * 2/2001 Klein ..... 211/163 X

* cited by examiner

*Primary Examiner*—Robert W. Gibson, Jr.
(74) *Attorney, Agent, or Firm*—Mills Law Firm PLLC

(57) ABSTRACT

A mobile stand for storing and organizing hand held puppets includes a base supported on swiveling casters and carrying a pair of vertically spaced display decks each of which includes a plurality of upwardly projecting support rods for carrying individual puppets.

6 Claims, 3 Drawing Sheets

MOBILE PUPPET STORAGE STAND

RELATED APPLICATION

This application claims the benefit under 35 USC 121 of U.S. Provisional Application No. 60/309,263 filed on Aug. 2, 2001 in the name of Herman R. Dean and entitled "Puppet Storage Stand".

FIELD OF THE INVENTION

The present invention relates to toy storage devices and, in particular, to a mobile stand for the storage of puppets.

BACKGROUND OF THE INVENTION

Puppeteers often use a number of puppets during the course of a performance. Each must be accessed readily for use and stored for reappearance without interrupting the show. When the performance is completed, the puppets must be transported for storage. Generally, the puppets are stored individually, separated for the performance and transported to the stage for use. Thereat the puppets are arrayed on the floor or raised surface for selection. The puppets may become entangled and difficult to access while maintaining the continuity of the show. Further, the puppets are often commingled in storage making retrieval of needed puppets for a given show difficult. The use is further complicated when additional gear is required for the movement of puppet arms and legs, which can become entangled with surrounding puppets.

SUMMARY OF THE INVENTION

In view of the foregoing, it would be desirable to provide a stand for organizing puppets during performances and storing in an organized and safe manner. The stand comprises a base on swiveled casters that carries at least one level of support rods on which the puppets are carried that may be rolled to the performance stage. The support rods may be oriented for grouping of puppets for a given performance. After performance, the stand may be transported and rolled to final destination, such as a closet, whereat the puppets are safely maintained in separated condition awaiting the next show.

Accordingly, it is an object of the present invention to provide a mobile stand for organizing and storing hand held puppets that may be conveniently transported on swivel casters between storage and performance locations.

Another object is to provide a puppet stand having a plurality of spaced support rods for holding individual hand held puppets in an organized array.

A further object is to provide a puppet stand having a roller supported base that can easily moved between locations and has a plurality of support rods for discretely carrying individual puppets.

DESCRIPTION OF THE DRAWINGS

The above and other objects and advantages of the present invention will become apparent upon reading the following detailed description taken in conjunction with the accompanying drawings in which.

DETAILED DESCRIPTION OF THE PREFERRED EMBODIMENTS

Figure 1:
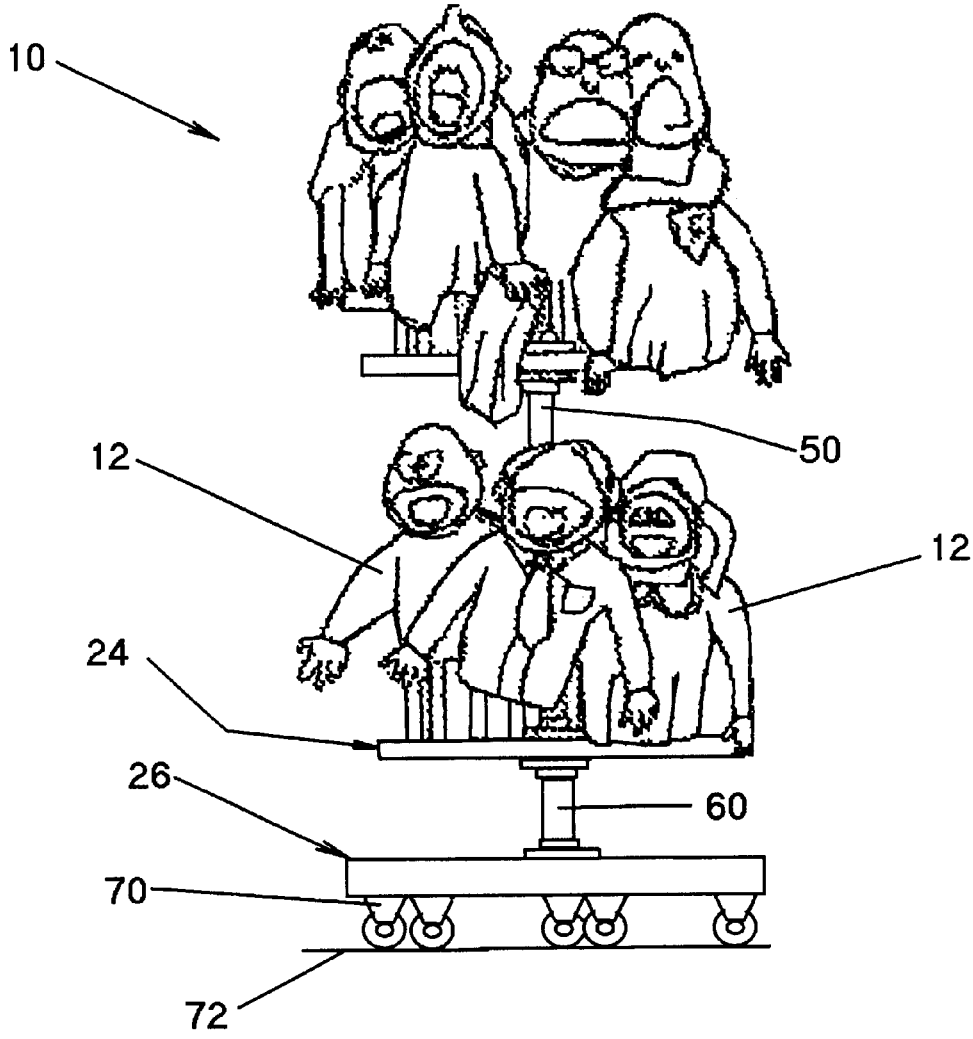
FIG. 1 is a side elevational view of a mobile puppet storage stand carrying puppets in accordance with a preferred embodiment of the invention.
Figure 2:
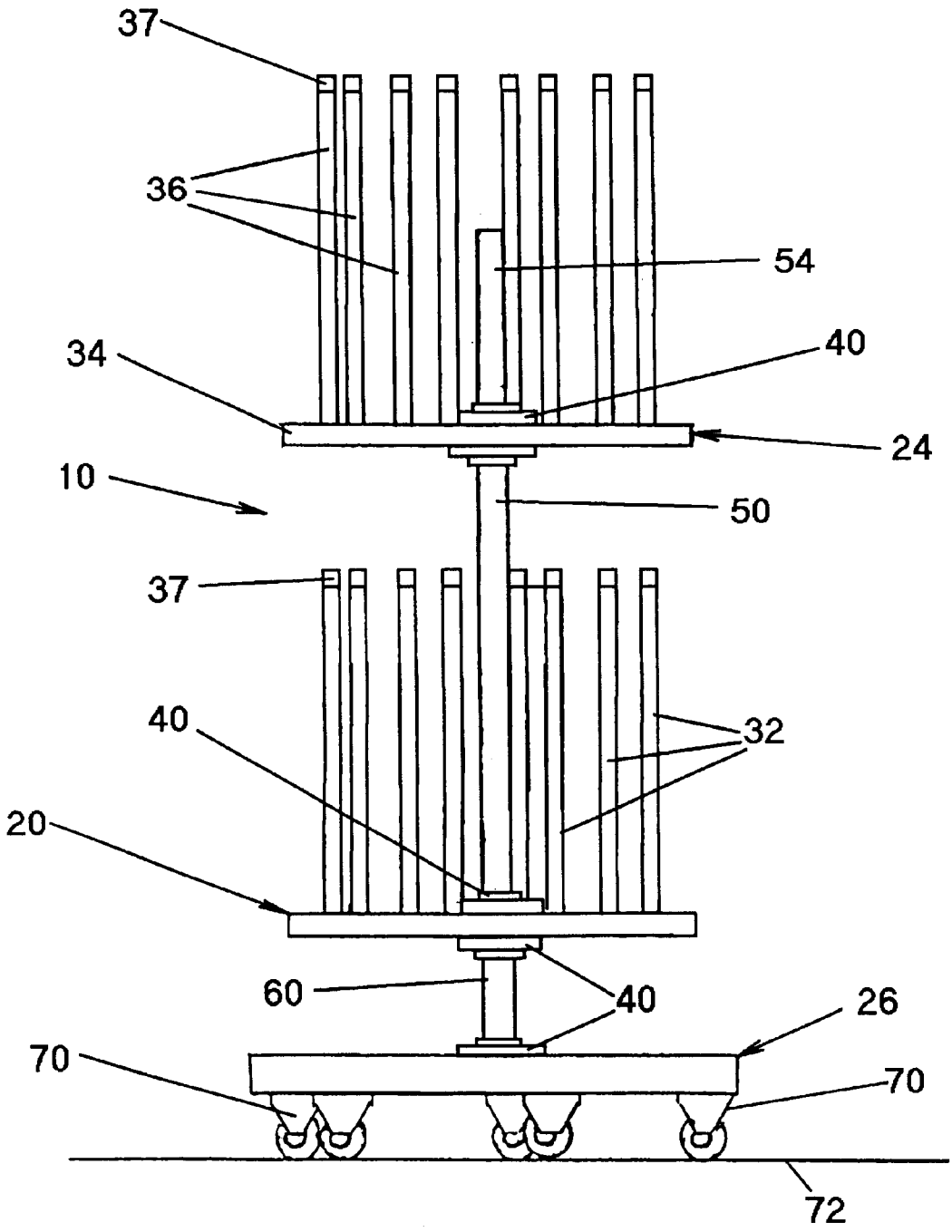
FIG. 2 is enlarged side elevational view of storage stand of FIG. 1.

Referring to the drawings for the purpose of describing the preferred embodiment and not for limiting same, FIG. 1 illustrates a mobile puppet support stand 10 for carrying and organizing a plurality of typical hand held puppets 12. As additionally shown in FIG. 2, the support stand 10 includes a lower display deck 20 and an upper display deck 24 located vertically thereabove. The decks 20 and 24 are carried on a mobile base platform 26.

The lower display deck 20 includes a circular base 30 carrying a circumferentially spaced series of vertically upwardly extending lower storage rods 32, which in use are received in the body sleeve for supporting the puppets thereon. The upper display deck 22 includes a circular base 34 carrying a circumferentially spaced series of vertically upwardly extending upper storage rods 36. Preferably, the bases 30, 34 are formed of a wood material, such as veneered plywood or solid wood, or a plastic material. The storage rods 32, 36 may be formed of conventional dowel material. For a plate diameter of about 24 inches, a circumferential series of 8 to 10 storage rods, 18 inches in length and ¾ inch diameter, may be supported on about an 18 inch diameter pattern. The rods 32, 36 are telescopically retained in countersunk holes in the top surface of the bases for discrete insertion and removal for facilitating grouping of puppets for performances. Alternatively, the rods may be mechanically or adhesively retained in the holes. The rods are covered at their distal upper ends with protective rubber tips 37 for minimizing damage to the puppet interior. The bases 30, 34, the platform 26 and the storage rods 32, 36 may be stained, painted or otherwise decoratively finished as desired.

Figure 3:
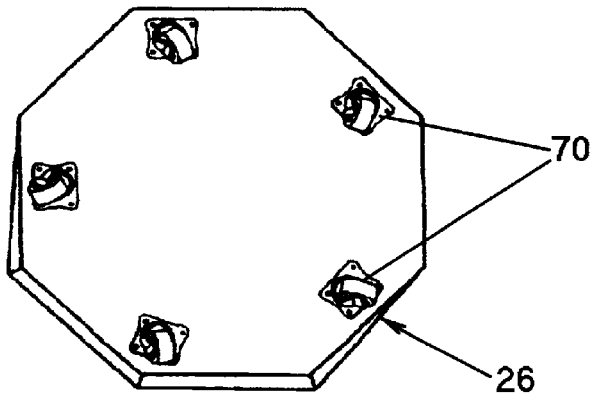
FIG. 3 is a bottom perspective view of the base platform and casters for the puppet stand of FIG. 1.
Figure 4:
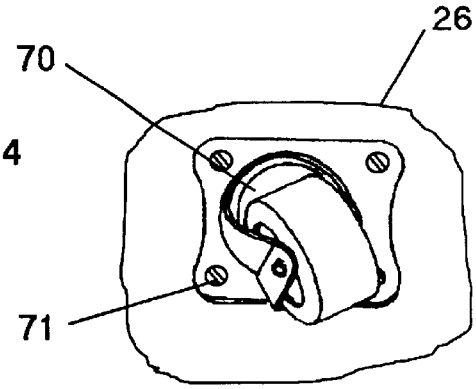
FIG. 4 is a bottom fragmentary perspective view of the caster and the base platform of FIG. 3.
Figure 5:
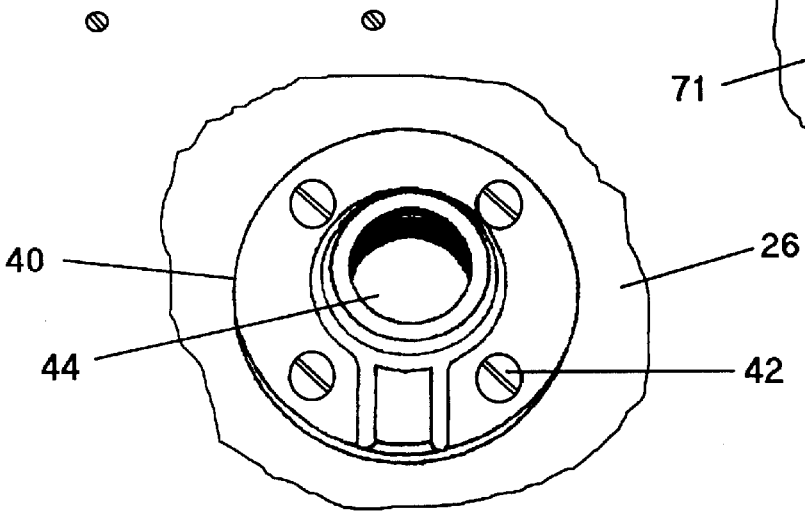
FIG. 5 is a to fragmentary perspective view of the mounting flange for storage stand.

Referring additionally to FIGS. 3 through 5, the decks 20, 22 include mounting flanges 40 attached coaxially at the top and lower surfaces thereof by threaded fasteners 42. The flanges 40 include a through bore 44 provided with internal pipe threads.

A support pipe 50 having threaded ends conventionally coupled to the opposed flanges structurally interconnects the decks 20, 22. The pipe 50 has a length greater than the storage rods 32 to provided sufficient clearance for mounting and removal of the individual puppets. A storage pipe 54 is connected to the upper flange on the top deck 24 and establishes an upwardly opening cylindrical cavity for holding and organizing additional puppet components such a hand bars and associated strings for operating the arms and legs of a puppet.

The base platform 26 is generally octagonal and formed from a material compatible with the decks. The base platform 26 includes a coaxially located support flange 40. A lower spacer pipe 60 includes threaded ends connected with the flanges 40 for supporting the lower deck 20 in spaced relation to the base platform 26, preferably about 6 inches apart.

Referring additionally to FIGS. 3 and 4, a plurality of peripherally spaced swivel casters 70, of commercially available construction, are attached at the periphery of the bottom surface of the base platform by suitable fasteners 71, such a wood screws. As will be appreciated, the casters 70 facilitate multidirectional translation of the support stand over a support surface 72 to allow the stand, without disassembly to be conveniently used and stored.

The stand is readily packaged in partially assembled component parts, including the base platform with casters and flange, and the decks with the flanges, together with the pipes 54, 50, 60 and the support rods 32, 36. The pipes may coupled to the flanges without tools by relative rotation to assemble the stand decks and base platform. The rods may then be inserted in desired locations with the remainder stored in the storage pipe 54 until needed. The stand may be readily transported between use and storage locations. During performances, the puppeteer may easily index the stand through rotation on the base platform on the caster for convenient access to the desired puppets. Further, the rods and associated puppets may be grouped for differing presentations. For a lesser number of puppets only a single base may be provided. Also, for a large number, three or more tiers may be provided.

Having thus described a presently preferred embodiment of the present invention, it will now be appreciated that the objects of the invention have been fully achieved, and it will be understood by those skilled in the art that many changes in construction and widely differing embodiments and applications of the invention will suggest themselves without departing from the sprit and scope of the present invention. The disclosures and description herein are intended to be illustrative and are not in any sense limiting of the invention, which is defined solely in accordance with the following claims.

What is claimed:

1. A storing and organizing apparatus for hand held puppets comprising:

a base member having an upper surface and a lower surface;

a plurality of swivel casters attached to said lower surface of said base member around the outer periphery thereof;

a first support member centrally connected to said upper surface of said base member and projecting upwardly therefrom wherein said first support member is attached at cylindrical flanges;

a first storage member having a lower surface connected to said first support member;

a first plurality of upwardly opening holes formed in an upper surface of said first storage member;

a first plurality of cylindrical support rods having lower ends telescopically received in said holes in said first support member and having upper ends for supporting the puppets thereon;

a second support member centrally connected to said upper surface of said first support members wherein said second support member is attached at cylindrical flanges and a second storage member having a lower surface connected to said first support member, said second support member having a length positioning said second storage member above said upper ends of said support rods for accommodating retention and removal of the puppets; and a second plurality of holes in an upper surface of said second support member, and a second plurality of cylindrical support rods having lower ends telescopically received in said second plurality of holes and having upper ends for supporting puppets thereon.

2. The storing and organizing apparatus as recited in claim 1 wherein said support members are cylindrical pipes having pipe threads at the ends thereof rotatably coupled to said cylindrical flanges.

3. The storing and organizing apparatus as recited in claim 2 wherein said storage members are cylindrical.

4. The storing and organizing apparatus as recited in claim 3 wherein said base member is polygonal.

5. The storing and organizing apparatus as recited in claim 4 wherein said base member is octagonal.

6. The storing and organizing apparatus as recited in claim 4 wherein a third support member having an upwardly opening cavity for carrying peripheral puppet supplies is carried on said upper surface of said second support member.

* * * * *